US009486046B2

(12) United States Patent
Krulik et al.

(10) Patent No.: US 9,486,046 B2
(45) Date of Patent: Nov. 8, 2016

(54) INTEGRATED POLYCARBONATE CASE

(71) Applicants: Richard Krulik, Northport, NY (US); Georgene Rada, Northport, NY (US); Matthew Dierkes, Mount Sinai, NY (US); Donald Hogan, Jersey City, NJ (US)

(72) Inventors: Richard Krulik, Northport, NY (US); Georgene Rada, Northport, NY (US); Matthew Dierkes, Mount Sinai, NY (US); Donald Hogan, Jersey City, NJ (US)

(73) Assignee: BRIGGS & RILEY TRAVELWARE LLC, Hauppauge, NY (US)

( * ) Notice: Subject to any disclaimer, the term of this patent is extended or adjusted under 35 U.S.C. 154(b) by 0 days.

(21) Appl. No.: 14/132,227

(22) Filed: Dec. 18, 2013

(65) Prior Publication Data

US 2014/0166416 A1 Jun. 19, 2014

Related U.S. Application Data

(60) Provisional application No. 61/739,477, filed on Dec. 19, 2012.

(51) Int. Cl.

| | |
|---|---|
| ***A45C 9/00*** | (2006.01) |
| ***A45C 5/02*** | (2006.01) |
| ***A45C 5/06*** | (2006.01) |

(52) U.S. Cl.

CPC .. *A45C 5/02* (2013.01); *A45C 5/06* (2013.01)

(58) Field of Classification Search

CPC ..... A45C 3/00; A45C 13/02; A45C 5/00; A45C 3/004; A45C 3/02; C08K 9/04

USPC ..... 190/111, 100, 109, 110, 119, 120, 122, 190/18 A; 150/103, 107, 117; D3/279; D7/607

See application file for complete search history.

(56) References Cited

U.S. PATENT DOCUMENTS

| | | | | |
|---|---|---|---|---|
| 4,925,021 | A * | 5/1990 | Pulichino, Jr. | A45C 3/001 190/109 |
| 5,054,589 | A * | 10/1991 | Bomes | A45C 3/00 190/110 |
| 5,105,920 | A * | 4/1992 | Grebenstein | A45C 5/00 190/103 |
| 5,109,961 | A * | 5/1992 | Bergman | A45C 13/262 150/117 |
| 5,358,082 | A * | 10/1994 | Armstrong, IV | A45C 7/0022 190/127 |
| 6,179,102 | B1 * | 1/2001 | Weber | A45C 3/00 150/112 |
| 6,325,189 | B1 | 12/2001 | King et al. | |
| 6,755,288 | B1 * | 6/2004 | Lai | A45C 13/04 190/122 |

(Continued)

FOREIGN PATENT DOCUMENTS

FR 2 903 582 A1 1/2008

OTHER PUBLICATIONS

International Search Report and Written Opinion dated Apr. 17, 2014 received from the Russian Patent Office from related Application No. PCT/US2013/076332.

(Continued)

*Primary Examiner* — Fenn Mathew
*Assistant Examiner* — Cynthia Collado
(74) *Attorney, Agent, or Firm* — Scully, Scott, Murphy & Presser, P.C.

(57) ABSTRACT

A hard-sided case is disclosed having a first housing member and a second housing member configured to form an interior compartment therebetween. Additionally, an external compartment lid is disposed on a planar surface of the second housing member. The external compartment lid is dimensioned and configured to seal a cavity formed on the planar surface of the second housing member to create an enclosed compartment.

14 Claims, 9 Drawing Sheets

(56) References Cited

U.S. PATENT DOCUMENTS

| | | | | |
|---|---|---|---|---|
| D516,870 | S * | 3/2006 | Martinez | D3/289 |
| 2001/0011620 | A1* | 8/2001 | Tiramani | A45C 5/02 190/124 |
| 2002/0148694 | A1 | 10/2002 | Tong | |
| 2007/0045072 | A1 | 3/2007 | Selvi | |
| 2011/0186398 | A1* | 8/2011 | Sheikh | A45C 7/0027 190/18 A |
| 2014/0311844 | A1* | 10/2014 | Meersschaert | A45C 5/02 190/122 |

OTHER PUBLICATIONS

Chinese Office Action dated Feb. 1, 2016 issued in corresponding Chinese Patent Appln. No. 201380066541.8 together with an English language translation.

* cited by examiner

INTEGRATED POLYCARBONATE CASE

RELATED APPLICATION

The present invention claims the benefit of U.S. provisional patent application 61/739,477 filed Dec. 19, 2012, the entire content and disclosure of which is incorporated herein by reference.

FIELD OF THE INVENTION

The present invention relates generally to luggage. More specifically, the present invention relates to hard-sided luggage.

BACKGROUND OF THE DISCLOSURE

Luggage is available in at least two distinct types, soft-sided luggage constructed of materials such as canvas, leather, and nylon fabric for example; and hard-sided luggage constructed of hard materials such as Aluminum, polycarbonate, and other metals and plastics. However, the hard-sided luggage provides greater protection for breakable items during travel where soft-sided luggage may become compressed, damaging fragile items contained therein.

SUMMARY OF THE DISCLOSURE

The present invention provides a hard-sided luggage or case having at least one externally accessible compartment. The compartment includes a hatch made of polycarbonate or other rigid, light-weight material.

An embodiment of the present invention includes a first housing member and a second housing member configured to form an interior compartment therebetween; and an external compartment lid disposed on a planar surface of the second housing member, the external compartment lid being dimensioned and configured to seal a cavity formed on the planar surface of the second housing member to create an enclosed compartment.

Another embodiment of the present invention includes a first housing member having a first cavity formed on a planar surface of the first housing member; a second housing member having a second cavity formed on a planar surface of the second housing member, and a third cavity formed on a second planar surface opposite the second cavity, the second cavity and third cavity being isolated from one another by an interior wall; a connecting member coupling the first housing member and the second housing member at a first side, the connecting member allowing the first housing member and the second housing member to form an enclosed volume therebetween, and defined by a summation of volumes of the first cavity and the second cavity; and an external compartment lid disposed on the second planar surface of the second housing member, the external compartment lid being dimensioned to seal the third cavity to create an enclosed compartment.

BRIEF DESCRIPTION OF THE DRAWINGS

These and other features, aspects, and advantages of the present invention will become better understood with regard to the following description, appended claims, and accompanying drawings wherein:

DETAILED DESCRIPTION OF DISCLOSURE

Figure 1:
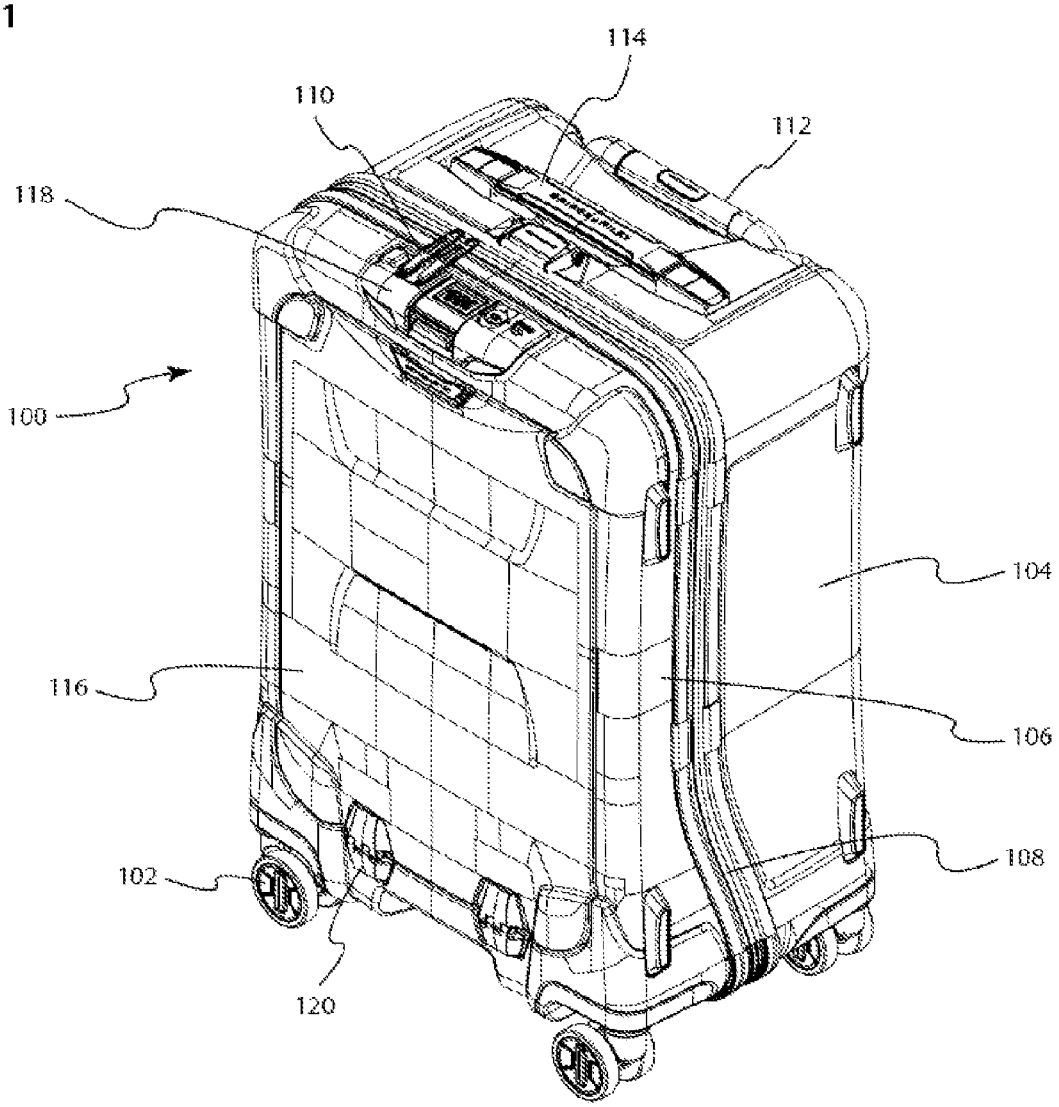
FIG. 1 illustrates an isometric projection of an embodiment of a hard-sided luggage in accordance with the present invention.
Figure 2:
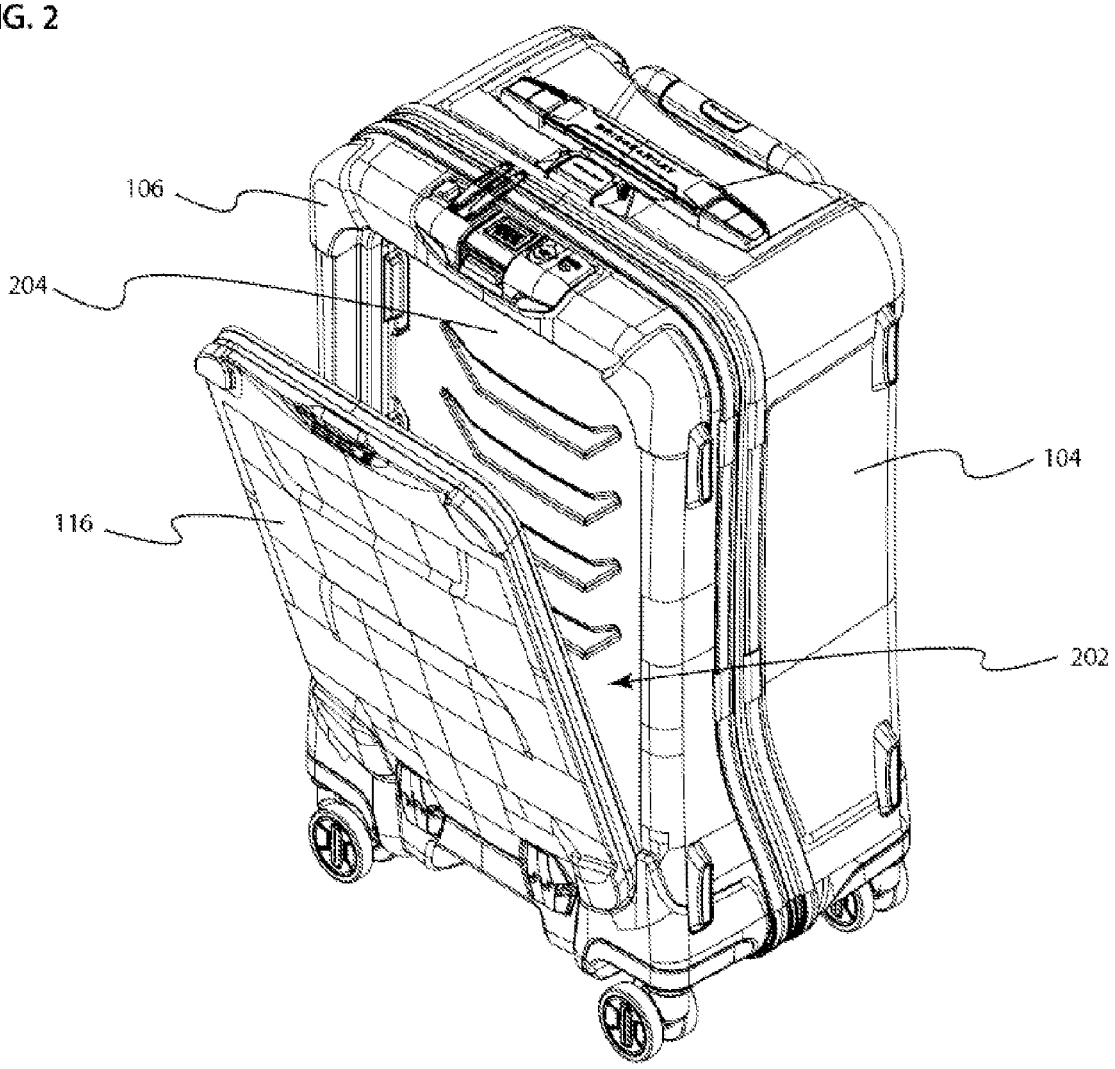
FIG. 2 illustrates an isometric projection of the embodiment shown in FIG. 1 with the externally accessible compartment shown in an open configuration.
Figure 4:
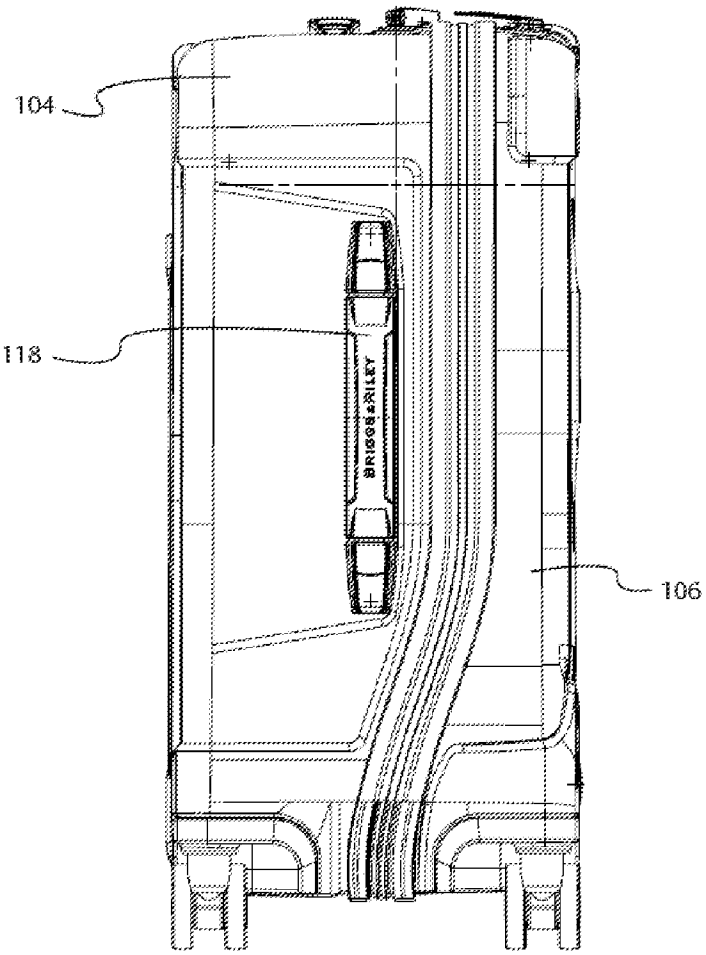
FIGS. 3-8 illustrate side views of an embodiment of the present invention.
Figure 3:
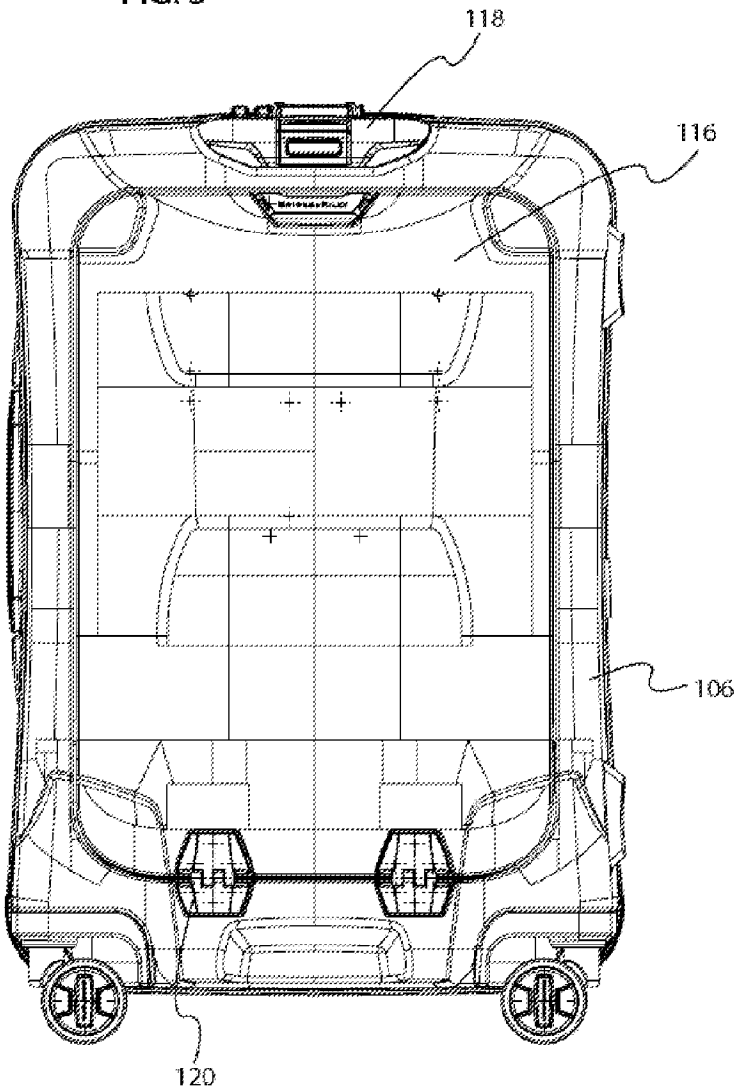
Figure 6:
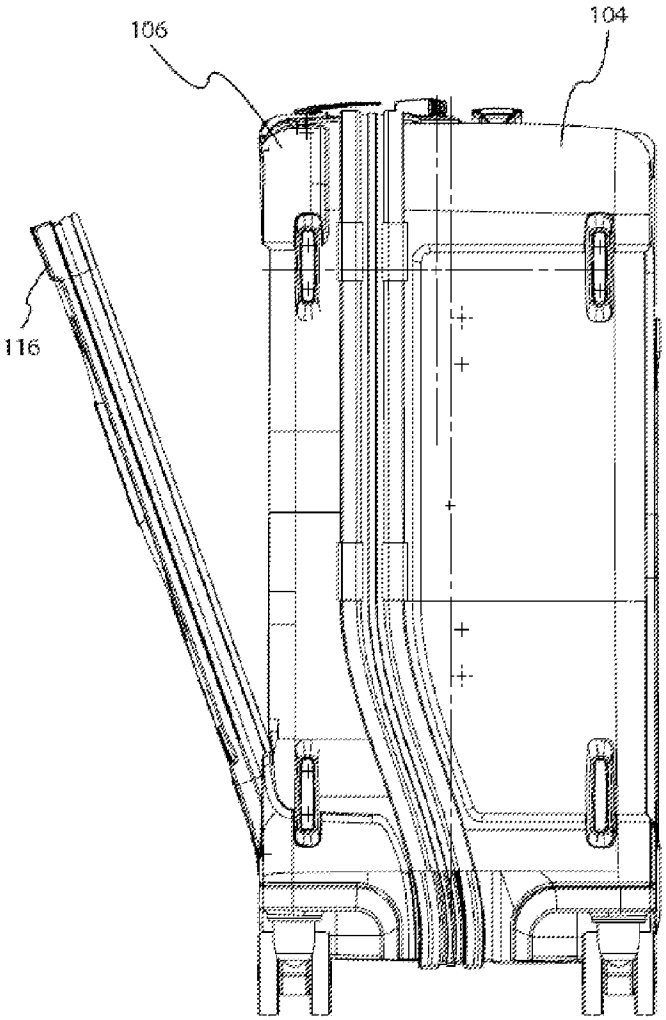
Figure 5:
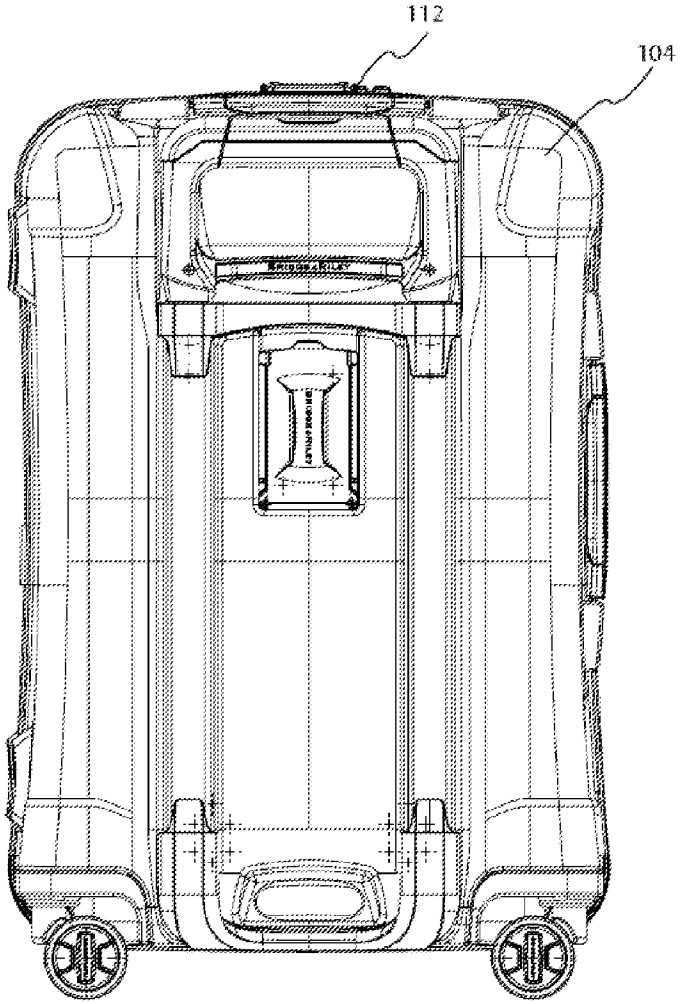
Figure 7:
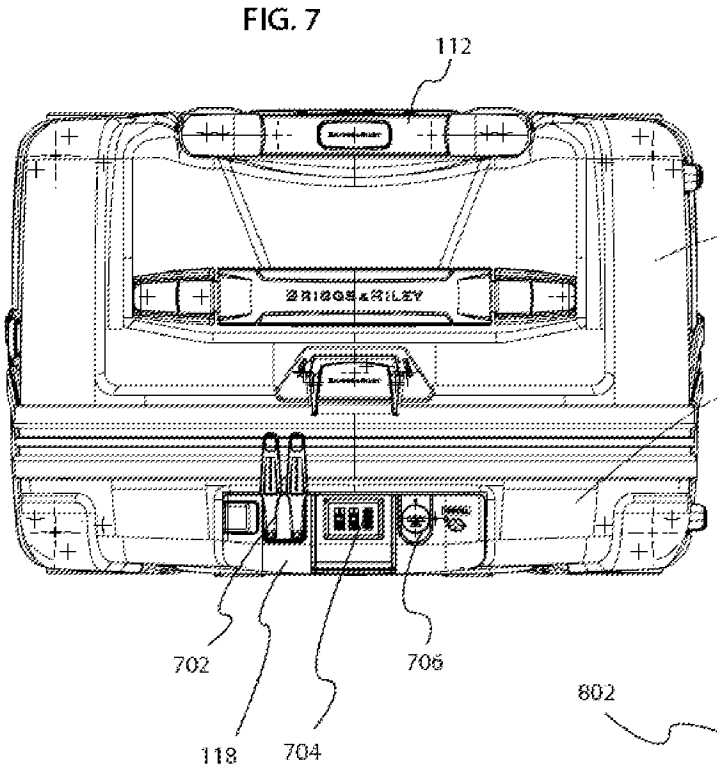

FIGS. 1-9, which represent exemplary embodiments of the present invention, will be described in detail hereinbelow. In the figures, like elements will be identified by like reference numerals.

Referring to FIGS. 1 through 8, a hard-sided case 100 of the present invention is shown. The case 100 includes a set of wheels 102 affixed to the bottom corners of the case 100, and configured as either fixed or swivelable. Additionally, the case 100 is formed of two shells, herein referred to as a main body 104 (i.e., first housing member) and a lid 106 (i.e., second housing member). The main body 104 and lid 106, each has a cavity formed on their respective planar surfaces that may be equally dimensioned or may have different depths along the Z-axis. The main body 104 and the lid 106 may have a depth ratio of 90:10 or 75:25 respectively.

Figure 8:
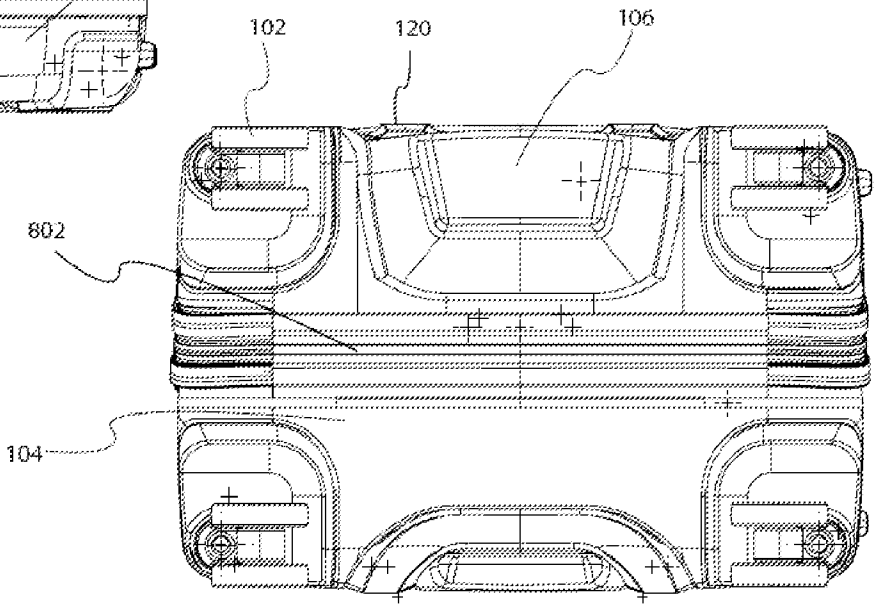
Figure 9:
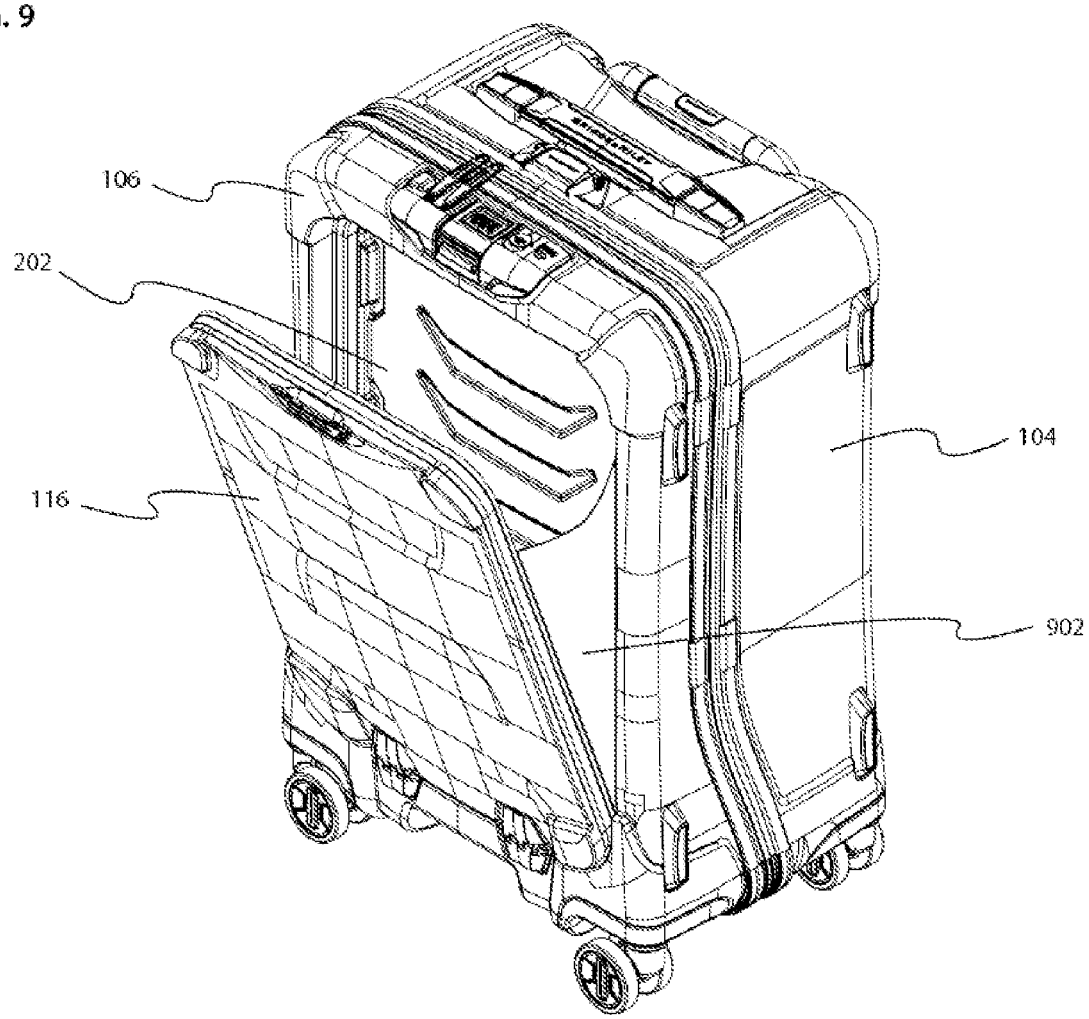
FIG. 9 illustrates an isometric projection of another embodiment of the present invention with the externally accessible compartment shown in an open configuration.

The main body 104 and the lid 106 are joined at a side by a connecting member 802 (shown in FIG. 8). The connecting member 802 may be constructed of a solid piece of flexible plastic, fabric, or one or more hinges of an appropriate type. Additionally, a zipper 108 is provided with a first tape half attached to the lid 106 and the second tape half attached to the main body 104 of the case 100. Movement of a slider body (not shown), by pulling on the pull-tabs 110, joins and un-joins the remaining perimeter of the main body 104 to the corresponding perimeter of the lid 106 in order to form an enclosed volume therebetween.

Thus, the zipper 108 and connecting member 802, taken together, form a continuous seal between the main body 104 and the lid 106. The seal formed by the zipper 108 and connecting member 802 need not be air or water tight. Nor is the seal required to be structurally continuous in that spaces may exist between the zipper 108 and the connecting member 802 as well as within the structure forming the connecting member 802. Alternatively, the seal formed between the main body 104 and the lid 106 may be air tight and water tight or water resistant.

The main body 104 also includes an extendable/retractable handle 112 that can be extended to allow the case 100 to be pulled or pushed along on its wheels 102. Furthermore, a top handle 114 may be provided to facilitate lifting of the case 100 as well. Additional handles or straps may be disposed at various positions and sides of the case 100 as deemed necessary for lifting, carrying, or otherwise transporting the case 100.

The lid 106 has an external compartment lid 116 disposed on a front exterior surface. The external compartment lid 116 openably encloses a void formed in the front exterior surface of the lid 106, and designated herein as external compartment 202. The external compartment 202 is sealed off from a compartment formed by the combination of the main body 104 and lid 106 (hereinafter referred to as "main compartment") by an interior wall 204.

The external compartment lid 116 is joined to the lid 106 by means of one or more hinges 120. As with the connecting member 802 described previously, the hinges 120 may be constructed of a solid piece of flexible plastic, fabric, or one or more hinges of an appropriate type. Additionally, in the embodiment shown in FIG. 9, the external compartment lid 116 is further connected to the lid 106 by a gusset 902 that may be fashioned of a stretchable or foldable material such as leather, nylon, plastic and textiles. The gusset 902 is dimensioned to provide lateral retention of items placed within the external compartment 202 such that the items are removable from the external compartment 202 from a direction generally directed towards the top of the case 100 as indicated by arrow 204.

Alternatively, the external compartment lid 116 and external compartment 202 may be disposed at any external surface of the lid 106 or main body 104 as appropriate. Moreover, multiple external compartment lids of various sizes and correspondingly placed and dimensioned external compartments may be provided at various locations on the exterior surface o the lid 106 and main body 104. Thus, the present invention is not limited to a singular external compartment 202 and external compartment lid 116 disposed on the front face of the lid 106, but any number of external compartments are envisioned in the present invention.

A locking mechanism "control panel" 118 is provided on the lid 106 of the case 100. The control panel 118 provides holds 702 configured to store the zipper pull tabs 110 in a secured position. Additionally, a combination or key lock 704 with a TSA over-ride 706 is provided for disengaging the pull-tabs 110 from the holds 702, and unlocking the external compartment lid 116. Thus, by manipulating the lock 704 or TSA over-ride 706 the external compartment 202 and the main compartment can be separately accessed. Moreover, the control panel 118 may be equipped with a retractable strap (not shown) configured to allow a second, smaller case to be attached to the luggage of the present invention. Also, an ID tag (not shown) may be disposed on the control panel 118, either as a separate structure attached to the control panel 118 by a strap or cord, or integrally formed on a surface of the control panel 118.

Figure 12:
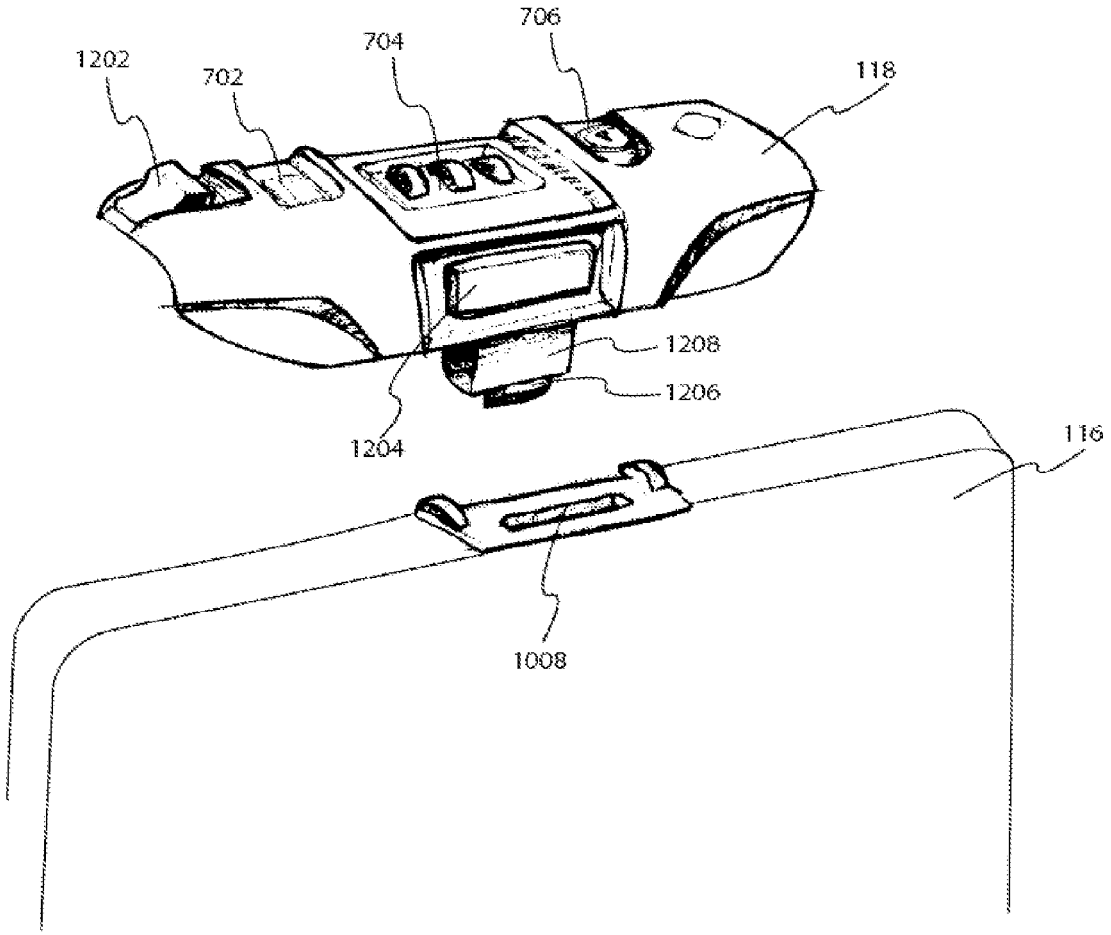
FIG. 12 illustrates an enlarged view of a locking mechanism of the present invention showing a locking mechanism for securing the externally accessible compartment lid.

FIG. 12 provides an enlarged view of the control panel 118. Specifically, the control panel 118 shown in FIG. 12 includes holds 702 in which the zipper pulls are lockably stored. A lever 1202 is provided on the control panel 118 to release the zipper pulls from the holds 702 when a correct combination is entered in the combination lock 704 or a TSA key actuates the TSA over-ride 706.

Additionally, the combination lock 704 and the TSA over-ride 706 unlock the external compartment 202 as well. By entering a correct combination in the combination lock 704 or a TSA key actuating the TSA over-ride 706, the button 1204 is released from a locked state, thus allowing the button 1204 to be depressed. Depressing the button 1204 causes latch 1206 to be retracted into the latch housing 1208, and out of the anchor opening 1008 formed on the external compartment lid 116. Retraction of the latch 1206 releases the external compartment lid 116.

The latch 1206 has a forward-facing bevel and is spring-loaded to allow the external compartment lid 116 to force the latch 1206 upward into the latch housing 1208 when the external compartment lid 116 is being closed. A spring (not shown) inside the latch housing 1208 is in contact with a surface of the latch 1206 and configured to provide a down-ward force on the latch 1206. The downward force provided by the spring causes the latch 1206 to drop into the anchor opening 1008 when the anchor opening 1008 and the latch 1206 are aligned. Once the latch 1206 is seated in the anchor opening 1008, the external compartment lid 116 cannot be released without depression of the button 1204.

The combination lock 704 may be configured with a single combination that allows the zipper pulls to be released from the holds 702 and releases the button 1204 from a locked state. Alternatively, the combination lock 704 may be configured to accept multiple correct combinations, with one combination being assigned to release the zipper pulls from the holds 702, and a second combination being assigned to release the button 1204 from a locked state.

Figure 10:
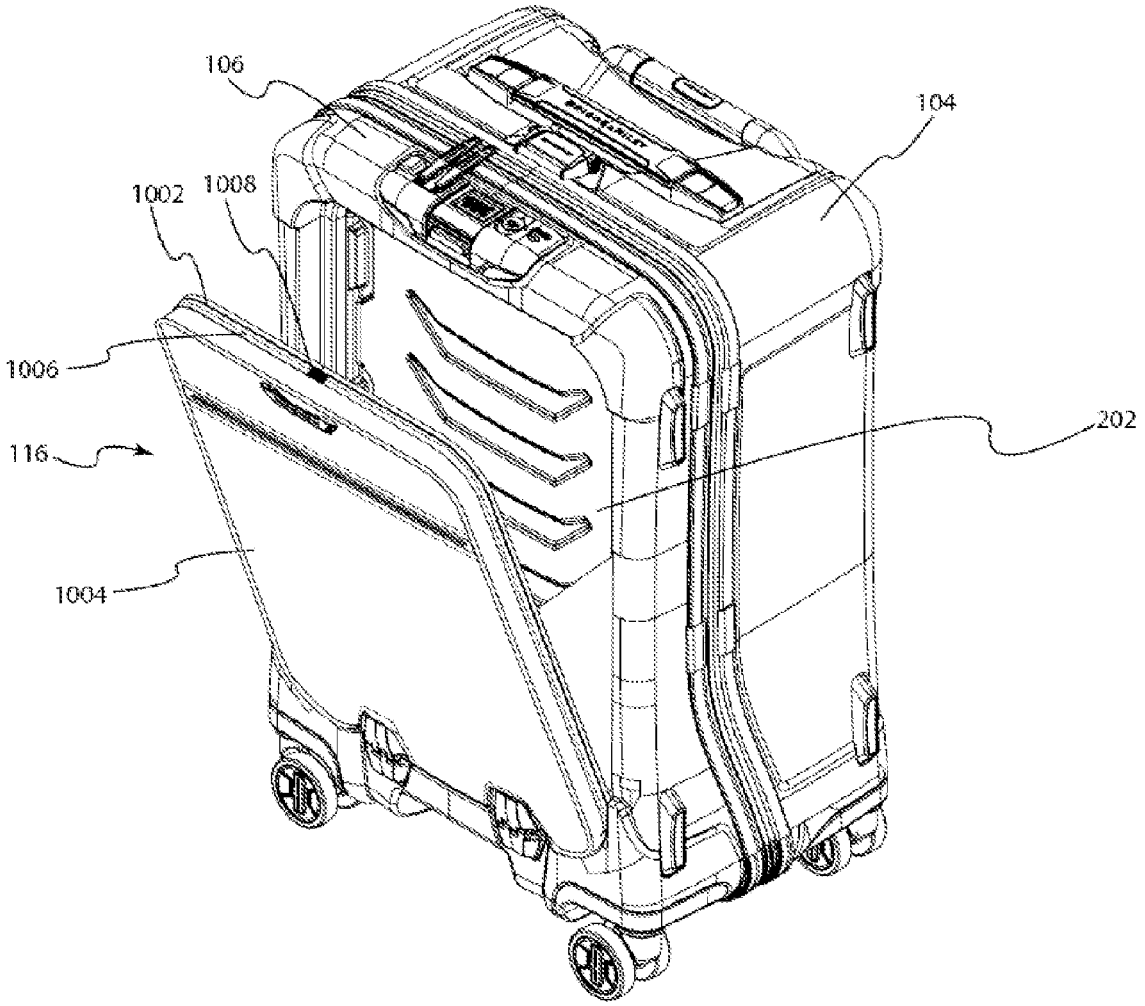
FIG. 10 illustrates an isometric projection of another embodiment of the present invention with the externally accessible compartment shown in an open configuration.

Turning to the embodiment shown in FIG. 10, a hard-sided case is shown which has a soft external compartment. The hard-sided case in FIG. 10 includes a main body 104 and a lid 106 configured as described above with respect to FIG. 1-9. However, in the embodiment shown in FIG. 10, the external compartment lid 116 is constructed of a rigid frame 1002 which supports a flexible cover material 1004. The frame 1002 is dimensioned to define the perimeter of the external compartment lid 116. Additionally, the frame 1002 also defines a central orifice 1006, represented by dashed lines, over which the flexible cover material 1004 is disposed. The flexible cover material 1004 is joined to the frame 1002 by any of the well known attaching means, such as adhesives, stitching, and riveting for example. The flexible cover material 1004 covers the orifice 1006, thus forming a solid lid structure.

The embodiment shown in FIG. 10 provides an external compartment that can accommodate larger or irregularly shaped objects that would not normally fit in a hard shell enclosure as described in the embodiments of FIG. 1-9. When a large or irregularly shaped object is placed in the external compartment 202 of the case of the present embodiment, the flexible cover material 1004 accommodates the object by stretching over and/or conforming to the shape of the object.

In the present embodiment, the frame provides an anchor 1008 for the locking mechanism (e.g., latch) disposed on the lid 106. The frame 1002 may be formed of any rigid light-weight material, such as aluminum, polycarbonate or other plastics. The flexible cover material 1006 may be formed of vinyl, leather, cotton, canvas, nylon, and other natural or manmade fabrics having sufficient durability.

Figure 11:
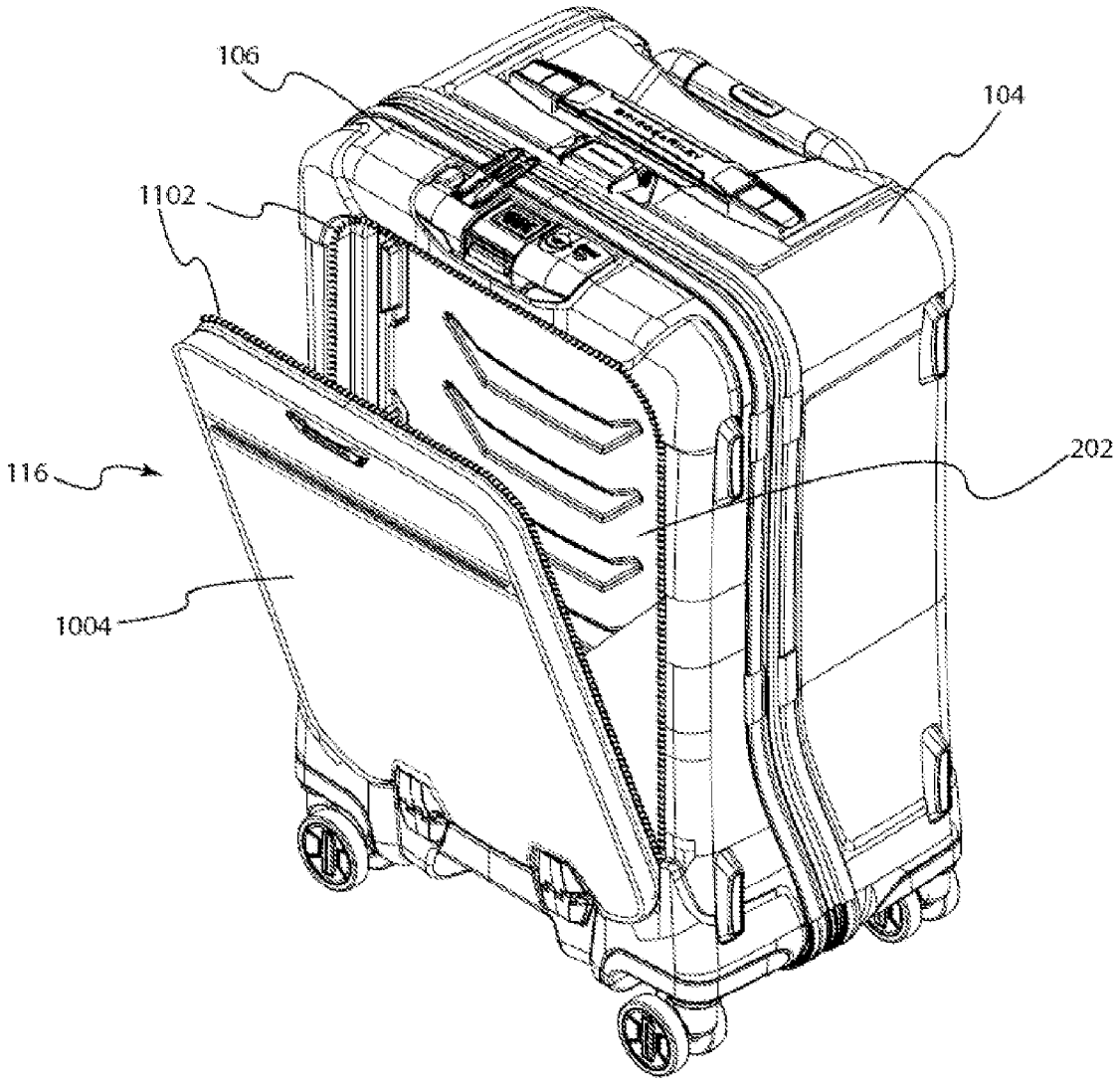
FIG. 11 illustrates an isometric projection of another embodiment of the present invention with the externally accessible compartment shown in an open configuration.

FIG. 11 shows another embodiment of the present invention having a flexible, or soft-sided external compartment lid 116. In the present embodiment, rather than a locking mechanism, the external compartment lid 116 is securely closed by means of a zipper 1102. In the present embodiment, the external compartment lid 116 may or may not have a rigid frame 1002 defining the perimeter of the external compartment lid 116. Alternatively, the material selected for forming the flexible cover material 1004 may be folded over at the edges in combination with the zipper to provide sufficient rigidity to the external compartment lid 116. Alternatively, ribbing (not shown) may be placed at the corners or sides of the external compartment lid 116 to provide sufficient rigidity. The ribbing may be formed of a plastic, wood, or aluminum material for example.

The described embodiments of the present invention are intended to be illustrative rather than restrictive, and are not intended to represent every embodiment of the present invention. Various modifications and variations can be made without departing from the spirit or scope of the invention as set forth in the following claims both literally and in equivalents recognized in law.

What is claimed is:

1. A hard-sided case comprising:

a first housing member having a first cavity formed on a planar surface of the first housing member, the first housing member including an extendable/retractable handle;

a second housing member having a second cavity formed on a planar surface of the second housing member, and a third cavity formed on a second planar surface opposite the second cavity, the second cavity and third cavity being isolated from one another by an interior wall;

a connecting member coupling the first housing member and the second housing member at a first side, the connecting member allowing the first housing member and the second housing member to form an enclosed volume therebetween, and defined by a summation of volumes of the first cavity and the second cavity; and an external compartment lid disposed on the second planar surface of the second housing member, the external compartment lid being dimensioned to seal the third cavity to create an enclosed compartment.

2. The case as in claim 1, wherein the first housing member and the second housing member are formed of polycarbonate plastic.

3. The case as in claim 1, wherein the first housing member and the second housing member are formed of aluminum.

4. The case as in claim 1, wherein the connecting member is formed of a flexible plastic material.

5. The case as in claim 1, wherein the connecting member is a hinge.

6. A hard-sided case comprising:

a first housing member and a second housing member configured to form an interior compartment therebetween, the first housing member including an extendable/retractable handle; and an external compartment lid disposed on a planar surface of the second housing member, the external compartment lid being dimensioned and configured to seal a cavity formed on the planar surface of the second housing member to create an enclosed compartment.

7. The case as in claim 6, wherein the first housing member and the second housing member are formed of polycarbonate plastic.

8. The case as in claim 6, wherein the first housing member and the second housing member are formed of aluminum.

9. The case as in claim 6, wherein the first housing member and a second housing member are joined at a first side by a flexible plastic material.

10. The case as in claim 6, wherein the first housing member and a second housing member are joined at a first side by a hinge.

11. The case of claim 1 further comprising bottom corners with swivelable wheels affixed thereto.

12. The case of claim 1 wherein the first housing member and the second housing member have a depth ratio of 90:10.

13. The case of claim 1 wherein the depth ratio is 75:25.

14. The case of claim 1 wherein the second housing member further comprises a locking mechanism control panel.

* * * * *